United States Patent [19]

Ezawa et al.

[11] Patent Number: 4,717,853

[45] Date of Patent: Jan. 5, 1988

[54] PROJECTION TUBE WHOSE COOLANT CONTAINS AN ETHYLENE OLIGOMER

[75] Inventors: Masayoshi Ezawa; Hiroko Wakui; Shigeru Wakana; Toshikazu Morishita; Akira Misumi, all of Mobara, Japan

[73] Assignee: Hitachi, Ltd., Tokyo, Japan

[21] Appl. No.: 836,822

[22] Filed: Mar. 6, 1986

[30] Foreign Application Priority Data

Mar. 6, 1985 [JP] Japan ..... 60-42656

[51] Int. Cl.[4] ..... H01J 29/89

[52] U.S. Cl. ..... 313/35; 313/477 R; 358/237

[58] Field of Search ..... 313/22, 35, 44, 45, 313/477 R; 358/237; 252/73, 79

[56] References Cited

U.S. PATENT DOCUMENTS

| | | | |
|---|---|---|---|
| 4,292,190 | 9/1981 | Davis et al. | 252/73 X |
| 4,529,905 | 7/1985 | Ohkoshi | 313/35 |
| 4,612,582 | 9/1986 | Tucker | 358/237 |

*Primary Examiner*—David K. Moore
*Assistant Examiner*—Sandra L. O'Shea
*Attorney, Agent, or Firm*—Antonelli, Terry & Wands

[57] ABSTRACT

Disclosed is a projection tube containing a coolant comprising a liquid mixture of ethylene glycol and water filled in the space between a phosphor screen panel and a transparent face panel which is set up at a certain distance in front thereof, wherein the coolant is incorporated with 10 ppm to 20 wt. % of an ethylene oligomer. The present projection tube is an excellent product free from a decrease in transmittance due to the coloring of the coolant in operation at a high temperature.

3 Claims, 1 Drawing Figure

PROJECTION TUBE WHOSE COOLANT CONTAINS AN ETHYLENE OLIGOMER

BACKGROUND OF THE INVENTION

This invention relates to a projection tube comprising a transparent face panel being set up at a predetermined distance in front of a phosphor screen panel, the circumference of the both panels being sealed with a metal bracket and the space between the panels being filled with a transparent coolant.

Generally in the liquid cooling projection tube of this type, the heat on the phosphor screen panel is conveyed, as known, by the convection of the coolant to the peripheral frame-shaped bracket, from which the heat is dissipated. As a result, the central part of the phosphor screen panel is controlled from temperature rise, so that the luminance can be prevented from lowering and panel cracks be prevented from occurring. If such a liquid cooling means is not employed, the luminance will decrease with the operating time and can no longer be recovered. In this case, moreover, the potassium chemical tempered glass layer on the surface of the panel will be cracked because of temperature rise. The liquid cooling projection tube has been described, for example, in Japanese Patent Laid-Open No. 154146/1983 (U.S. Pat. No. 4,543,510).

The projection tube of the above type has used a coolant which is normally a liquid mixture of ethylene glycol and water, and this coolant would become colored on operation especially at a high temperature for a long time. On operation at a temperature of 60° C. for 40 hours, for instance, the coolant became substantially colored, and its transmittance decreased to 60%. It goes without saying that if the temperature and/or the operating time exceeds the above, the coloring of the coolant and the drop of transmittance will further proceed. This is because the sodium in the panel glass or the potassium in the potassium chemical tempered glass layer on its surface dissolves in the water of the coolant, and these alkali metal ions act to decompose ethylene glycol, causing the coolant to decrease its transmittance and a picture defect to occur.

SUMMARY OF THE INVENTION

An object of this invention is to solve the abovementioned faults in prior art and to provide a projection tube which is devised so that the transmittance can be prevented from lowering on account of the coolant being colored in operation at a high temperature.

In order to attain this object, the projection tube of this invention uses a coolant comprising a liquid mixture of ethylene glycol and water incorporated with 10 ppm to 20 wt. % (hereinafter "ppm" and "%" denote those by weight) of an ethylene oligomer.

DESCRIPTION OF THE PREFERRED EMBODIMENTS

Figure 1:
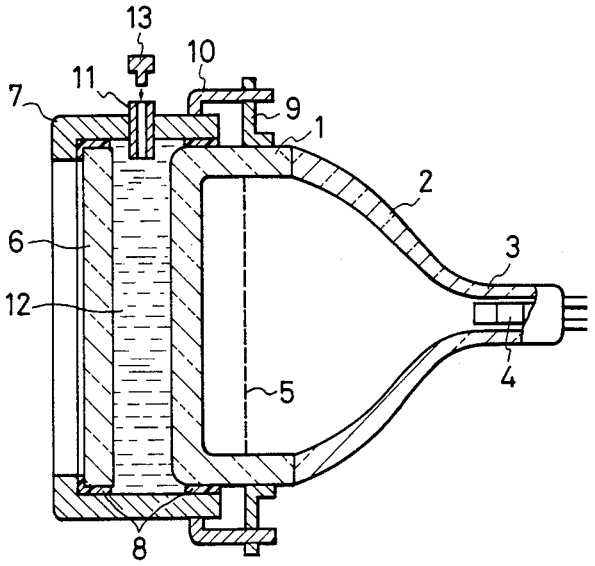
FIG. 1 a schematic sectional view of a projection tube in an embodiment of this invention.

FIG. 1 is a side sectional view of main components of the projection tube in the present embodiment.

In this figure, numeral 1 is a phosphor screen panel which composes a valve together with a funnel portion 2. A phosphor screen comprising phosphor 15 picture elements in three colors of red, green and blue, which herein is omitted in the sectional view, is formed inside the phosphor screen panel 1 opposing to the electron gun 4 which is installed in the neck portion 3. Numeral 5 is a shadow mask fixed between this phosphor screen and the electron gun 4.

Numeral 6 is a transparent face panel which is positioned in front of the phosphor screen panel 1; these panels are fixed firmly to each other via a frame-shaped aluminum bracket 7 which is arranged in the peripheral portion, using an adhesive 8. Numeral 9 is a fixture fastened to the phosphor screen panel 1, and 10 is a fixture fastened thereto with a screw, whereby the bracket 7 is fastened more firmly to the phosphor screen panel 1.

A coolant inlet 11 is provided on the upper portion of the bracket 7, and the space between the two panels 1 and 6 is filled with a coolant 12 which is introduced from the inlet 11. The inlet 11 is to be sealed with a screw cap 13.

In the above-mentioned structure, the heat generated in front of the phosphor screen panel is conveyed by the convection of the coolant 12 to the peripheral bracket 7, from which the heat is dissipated.

The phosphor screen panel 1 and the face panel 6 are both made of transparent glass, whose surface is covered with a potassium chemical tempered glass layer where sodium has been substituted by potassium for increasing the mechanical strength and preventing the panel glass from cracking. In the present example, the outer surface of the phosphor screen panel 1 and the whole surface of the face panel 6 are covered with a potassium chemical tempered glass layer, because they are to be soaked with an aqueous $KNO_3$ solution. However, those portions of the face panel 6 which are not exposed to the coolant 12 need not necessarily be made of a potassium chemical tempered glass layer.

The coolant 12 is a liquid mixture of ethylene glycol and water, which is incorporated with 10 ppm to 20% of an ethylene oligomer. In this example, the volume ratio of ethylene glycol to water is 4:1. However, the coolant may be in the conventional composition, and need not be limited to the above specified ratio. The ethylene oligomer is a mixture of ethylene glycol polymers represented by the general formula $HO\text{-}[CH_2\text{-}CH_2\text{-}O]_n\text{-}H$ ($n=2\sim16$). By its addition of at least 10 ppm, the decomposition of ethylene glycol by the sodium or potassium exuded from the panel glass or from its potassium chemical tempered glass layer can be prevented and the picture defect due to the coloring of the coolant can be reduced to nothing. In the general formula of ethylene oligomer, the value of n, i.e. the degree of polymerization, should be 2 to 16 as specified above, more preferably 2 to 12, whereas the best results can be obtained when n is 4 to 8.

The coolant 12, when incorporated with too much ethylene oligomer, will have an increased viscosity, so that the operation efficiency in its introduction from the inlet 11 will be lowered and its movement by convection be hindered to cause the heat dissipation effect to decrease. Therefore, the amount of the oligomer added should no exceed 20%. Thus, the amount of its addition should be more preferably within the range of 500 ppm to 15%, most preferably 1 to 5%.

In the embodiment mentioned above, the phosphor screen has phosphor picture elements in three colors. However, the present invention can be employed in the monochrome projection tube. In this case, usually, the phosphor screen has the red, green or blue emitting monochrome phosphor, and the shadow mask 5 should not be comprised.

As explained above, this invention has made it possible to realize a good projection tube which is free from a decrease in transmittance due to the coolant being colored in operation at a high temperature, by incorporating 10 ppm to 20% of an ethylene oligomer in the coolant consisting of ethylene glycol and water.

In the projection tube of the present invention, conventional knowledges and known teachings may be adopted in connection with matters not specifically described in the instant specification.

What is claimed is:

1. A projection tube containing a coolant comprising a liquid mixture of ethylene glycol and water filled in the space between a phosphor screen panel and a transparent face panel which is set up at a predetermined distance in front thereof, wherein the coolant is incorporated with 10 ppm to 20 wt. % of an ethylene oligomer having a degree of polmerization of 4 to 8.

2. A projection tube as set forth in claim 1, wherein the ethlene oligomer is added in an amount of 500 ppm to 15 wt. %.

3. A projection tube as set forth in claim 1, wherein the ethylene oligomer is added in an amount of 1 to 5 wt. %.

* * * * *